US008695507B1

(12) United States Patent
Musali et al.

(10) Patent No.: US 8,695,507 B1
(45) Date of Patent: Apr. 15, 2014

(54) COMPOSITE SABOT

(75) Inventors: Saif Musali, Wharton, NJ (US); Munasir Harhara, Montclair, NJ (US); Nicholas Payne, Hoboken, NJ (US); Roger Joinson, Boonton, NJ (US); Velan Mudaliar, Parsippany, NJ (US); Daniel Prillaman, Flushing, NY (US); Shri Singh, Randolph, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 13/302,183

(22) Filed: Nov. 22, 2011

Related U.S. Application Data

(60) Provisional application No. 61/491,959, filed on Jun. 1, 2011.

(51) Int. Cl.
*F42B 14/06* (2006.01)

(52) U.S. Cl.
USPC ..... 102/521; 102/524; 102/526

(58) Field of Classification Search
USPC ..... 102/520, 521, 522, 523, 524, 526
See application file for complete search history.

(56) References Cited

U.S. PATENT DOCUMENTS

| | | | | | |
|---|---|---|---|---|---|
| 4,953,466 | A | * | 9/1990 | von Gerlach | 102/521 |
| 4,958,571 | A | * | 9/1990 | Puckett | 102/522 |
| 5,259,321 | A | * | 11/1993 | Pahnke | 102/521 |
| H1412 | H | * | 2/1995 | Kline et al. | 102/521 |
| 5,789,699 | A | * | 8/1998 | Stewart et al. | 102/521 |
| 6,125,764 | A | * | 10/2000 | Kamdar | 102/520 |
| 7,935,208 | B2 | * | 5/2011 | Park et al. | 156/212 |
| 2013/0000506 | A1 | * | 1/2013 | Minnicino, II | 102/521 |

FOREIGN PATENT DOCUMENTS

GB 2251676 A * 7/1992

* cited by examiner

*Primary Examiner* — James Bergin
(74) *Attorney, Agent, or Firm* — Henry S. Goldfine

(57) ABSTRACT

A lightweight composite sabot useful in large, medium and small caliber rifled gun systems, wherein each of the sabot segments are reinforced with thin aluminum, or other, metal wedges to increase the torsional strength of the sabot body to survive the torsional forces created when fired from a rifled gun tube. And, which composite sabot also has a metal bulkhead about the periphery thereof, to reduce the spin and resulting hoop stresses, and to help protect the composite material during firing.

7 Claims, 4 Drawing Sheets

COMPOSITE SABOT

CROSS-REFERENCE TO RELATED APPLICATIONS

This application claims the benefit under 35 USC §119(e) of U.S. Provisional Patent Application No. 61/491,959, filed on Jun. 1, 2011, which provisional application is hereby incorporated herein in its entirety.

FEDERAL RESEARCH STATEMENT

The invention described herein may be manufactured, used, and/or licensed by the U.S. Government for U.S. Government purposes, without the payment of any royalty therefore.

FIELD OF THE INVENTION

The present invention relates to military sabots, and particularly to such devices with light weight construction, to provide increased velocity and kinetic energy upon impact, and enhanced hoop strength both along the length of the sabot and about the obturator band, to survive launch from rifled gun tube systems.

BACKGROUND OF THE INVENTION

High density, long rod penetrators in the form of flechettes, pointed projectiles with vaned tails for stable flight, are utilized as anti-amour weapons, i.e. kinetic energy penetrators. Such kinetic energy (KE) penetrators are subcaliber and encased within a light weight aluminum alloy or composite material sabot that surrounds and builds out the diameter of the unit to allow it to be fired from the particular caliber weapon. The sabot is typically constructed in three segments; which segments are wrapped around the penetrator and typically held together by an obturator band located near the sabot's midsection, a bourrelet ring in the front and a tipping ring at the tail end of the sabot. The sabot has a windshield and a windshield tip in the front and at its back end a tail fin. The front bourrelet ring and the tipping tail end ring are both notched or otherwise weakened, or prestressed. Upon ignition of the propellant charge inside a cartridge case which holds the sabot—the KE projectile is propelled from the gun tube—the propulsion force being provided by a seal created between the sabot and the gun tube by the obturator ring. Upon exit from the muzzle of the gun tube, typically the sabot's front scoop catches the air rushing by the projectile and forces the sabot sections apart, such that the obturator band and retaining bands about the nose and tail of the sabot break, freeing the segments of the sabot to separate and fall away from the KE penetrator, such as a typical "Armor-Piercing Fin-Stabilized Discarding Sabot" or APFSDS. After the sabot sections are discarded, the KE penetrator continues to fly down range to impact the target with enough kinetic energy to defeat its intended target.

As stated above, sabots have traditionally been manufactured of light weight aluminum—wherein such a relatively light material provides increased muzzle velocity and correspondingly increased range and penetration by the subcaliber penetrator at the target. One example of such an aluminum APFSDS is the M900 105 mm sabot, which can be fired from the 105 MM M68 main gun on the M1 Abrams Tank or the Stryker Mobile Gun System. Another, example is the M829

APFSDS tank round designed for the 120 mm M256 main gun on the M1A1, M1A2 and M1A2 SEP Abrams main battle tank.

While aluminum is a relatively light weight metal, it is certainly heavy when compared to modern composite materials. However, while composite sabot structures have successfully been used in 120 MM smooth bore gun systems, where there is no spin, i.e. no significant torsional loads; the use of such composite materials in rifled gun systems has failed—composite sabot structures provide only a very low torsional load capability of about the order of 7000 inch-pounds and the spin effect from being fired from a rifled gun causes loss of the sabots body integrity (i.e. the sabots composite structure literally comes apart). To strengthen sabots for use in rifled gun systems, past attempts to introduce metal supports in the molding process have failed due to incompatibility of coefficient of expansion and contraction of the dissimilar composites and metal materials. Further, the obturator of a composite sabot is subjected to significant friction, heat and pressure forces during firing from a rifled barrel—such that there is a significant risk of material failure. Regardless, use of such significantly lighter weight composite material sabots, such as APFSDS, which could be fired at much higher muzzle velocities, to provide increased range, and target penetration—which is certainly desirable to enhance the performance of rifled weapons, such as 105 mm APFSDS and the 120 mm APFSDS.

Clearly there is a need in the art for a light weight, lower mass, composite material sabot, that can be fired from rifled gun tubes with greater velocity; but, which has the torsional/hoop strength to survive the forces created by the launch spin of a rifled gun tube; which are constructed such that there is no damage to the sabot's composite material due to the physical conditions to which it is exposed; and, which is constructed so as to reduce the spin, thereby reduce the hoop stresses.

SUMMARY OF INVENTION

The present invention comprises a lightweight, metal reinforced, composite sabot projectile, such as an APFSDS—useful with large caliber rifled gun systems, such as 105 mm or 120 mm rifled gun systems, as well as, with medium and small caliber rifled gun systems. In the present invention, thin aluminum, or other thin metal, wedges or plates, are aligned with and joined along the longitudinal axis of each sabot segment, or petal, that is manufactured of a lightweight composite material; one such wedge joined to each side of each composite sabot segment (whereby the composite sabot segments are each sandwiched between two metal wedges); the sandwiched wedges are positioned so as to form the 360 degree sabot structure about the KE penetrator, and joined together using the traditional weakened or pre-stressed bands—usually, one about the rear, one about the obturator band, and one about the front tip of the sabot. The sabot formed by the composite segments and reinforcing metal wedges has proven to have the torsional strength necessary to survive firing from a rifled gun tube, i.e. a spin environment, without any loss of its body integrity—while being much lighter than the prior art all aluminum sabots.

The above detailed metal wedges are joined to each side of each composite sabot segment, after the composite segment is molded, by either mechanical means, or glue, or a combination thereof. Such composite material sabots, with the reinforcing aluminum wedges according to the present invention, provide about a 25% reduction in parasitic mass vs. the present all aluminum construction. This reduction in mass provides the desired significantly higher muzzle velocity, extended range capability of the KE penetrator, and enhanced armor defeat by the KE penetrator.

The present invention, in addition to utilizing the above detailed reinforcing aluminum, or other metal wedges; also, preferable has a metal surface joined to and about the periphery of the obturator ring, i.e. the side facing the inner side of the gun tube. Such a metal surface, or metal bulkhead, helps protect the sabot's composite material from the physical forces created where the obturator rides on the sabot. Further, and importantly, such a metal surface on the composite sabot provides a metallic surface to the obturator and the slip band mechanism and thus reduce the spin, thereby reducing the hoop stresses on the sabot.

In a preferred embodiment of the present invention, a three segment or petal sabot can be constructed such that each composite segment or petal covers from about 90 to about 110 degrees of arc about the circumference of the sabot, each such composite segment being sandwiched between a thin aluminum, or other thin metal, wedge covering from about 5 to about 15 degrees of arc about the circumference of the sabot—the six thin metal wedges being joined, one to the next, to form with the composite segments the 360 degrees of circumference of the sabot, as it encloses the subcaliber KE penetrator. The thin aluminum wedges can preferable be as thin as about 5 degrees of arc—but, to provide the necessary hoop strength the wedge should not be any thinner than about 3 degrees of arc.

The sabot of the present invention has at least 3 segments manufactured of a composite material, sandwiched between reinforcing metal wedges; however, the sabot may have 4, 5, or more such segments. As stated above, the reinforcing metal wedges should be at least about 3 degrees of arc—to provide the necessary torsional strength to withstand the spin environment from a rifled gun tube. Maximizing the ratio of composite to aluminum is desired, to minimize the weight, i.e. mass, of the sabot—to realize the greatest muzzle velocity—for the greatest range and penetration of the penetrator on target—while providing the necessary torsional/hoop strength for the composite sabot to survive the launch from rifled gun tube.

DETAILED DESCRIPTION OF THE INVENTION

Figure 1:
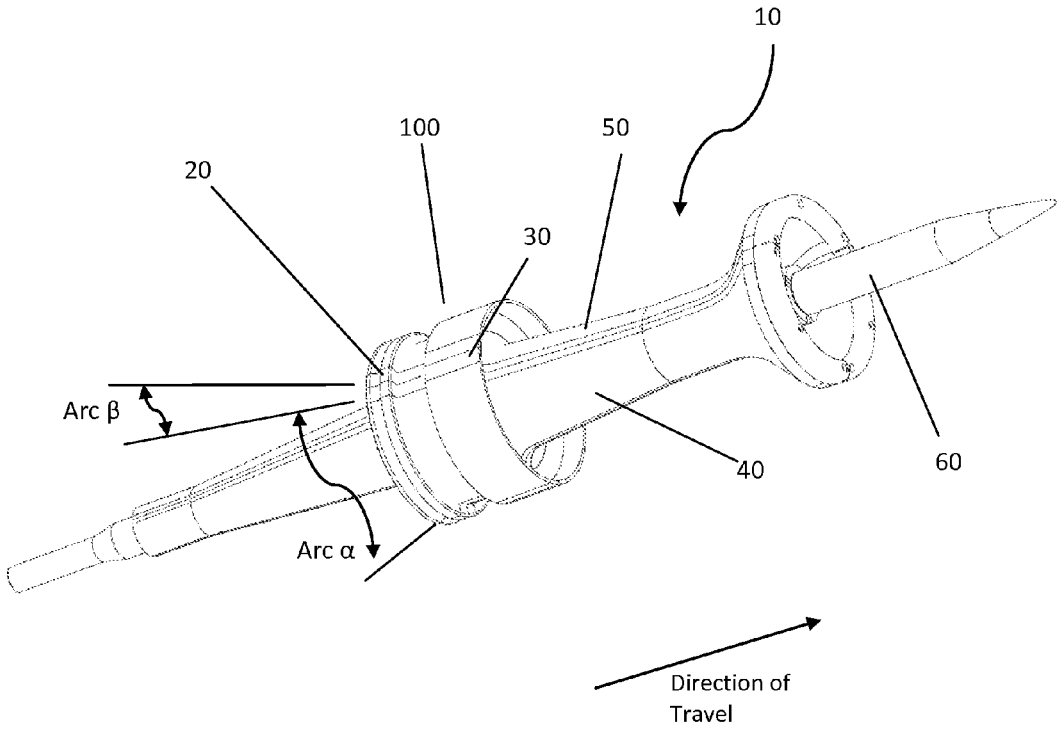
FIG. 1. is a perspective view of a lightweight composite sabot projectile of the present invention with a metal wedge on each side of each composite segment of the sabot.

The present invention comprises a lightweight metal insert reinforced composite sabot projectile for use with large caliber, such as 105 mm or 120 mm rifled gun systems, as well as, medium and small caliber rifled gun systems. Referring to FIG. 1, a sabot of the present invention, 10, wherein, aluminum wedges or plates 20, 30, are inserted longitudinally along the longitudinal axis of the sabot, one aluminum wedge being bonded to each side of each lightweight composite material sabot segment 40, 50 (i.e. sandwiching the composite material segment); each wedge 20, 30, having an identical outline as the composite material sabot segment 40, 50, to which each is affixed; thereby, providing a reinforced composite sabot having the torsional strength required to survive being launched from a rifled gun tube without any loss of its body integrity. The subject sandwiched composite material sabot segments are aligned and held together by mechanical means to form the completed sabot, which contains, i.e. retains therein, the subcaliber KE penetrator (thereby allowing the subcaliber KE penetrator to be fired from the particular caliber gun tube).

The mechanical means by which the sabot segments held together is known technology, typically a set of weakened ties. It is standard practice to join the sabot segments together, about the KE projectile, with such a set of weakened ties or bands that are stressed, or notched, or otherwise designed to fail after the sabot has exited the gun tube and is subjected to the force of the air being caught in its front scoop during flight. In the prior art, a set of three weakened ties are generally used—one located near and about the rear of the sabot, one about the obturator ring, and one near and about the nose or front tip of the sabot (which bands are not shown in the various FIGS).

Figure 2:
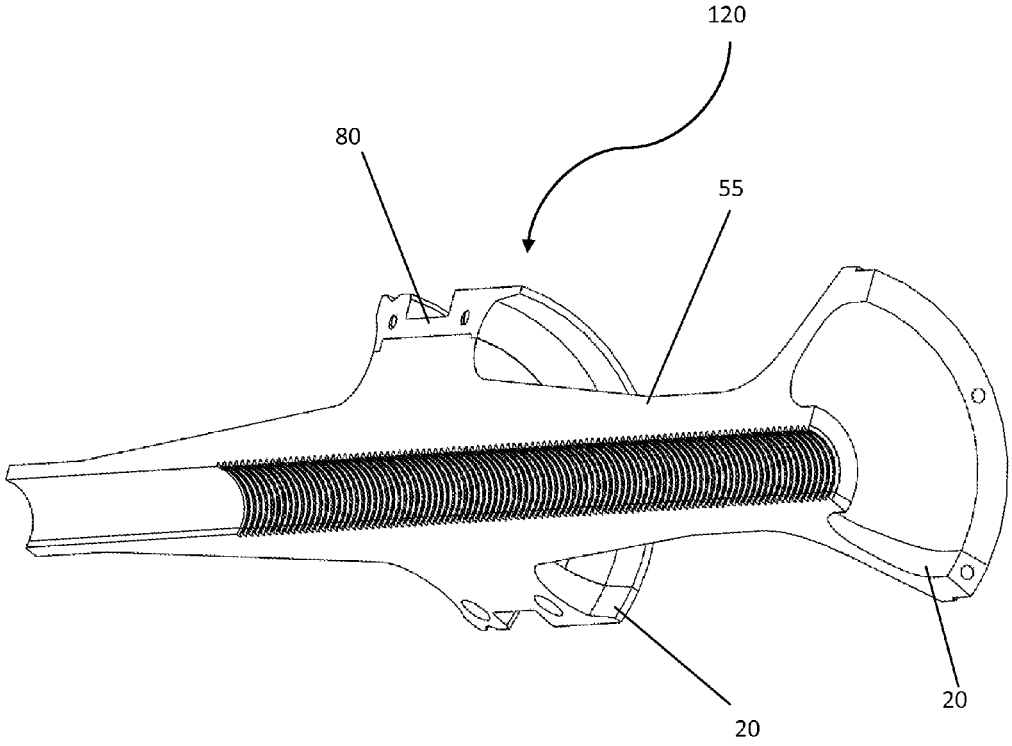
FIG. 2. is a perspective view of a single composite sabot segment according to the present invention—showing a metal wedge joined to its lower side and a metal bulkhead about the obturator thereof.
Figure 3:
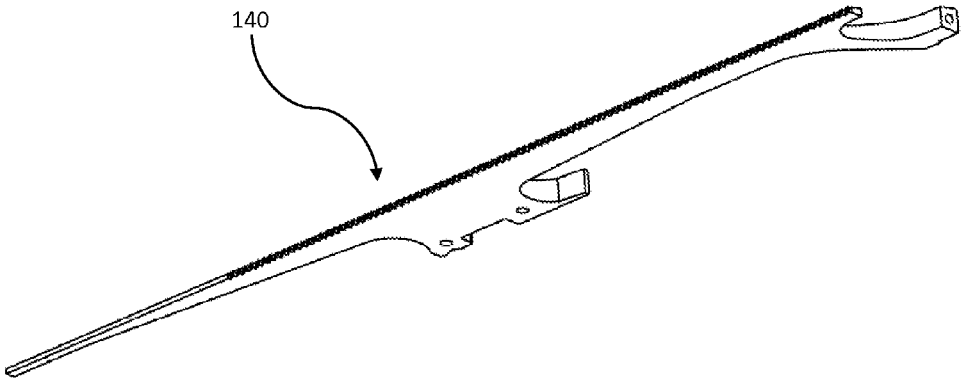
FIG. 3. is a perspective view of a sabot metal wedge according to the present invention.

Shown in FIG. 3 is a metal wedge, 140, which is joined to each side of each composite sabot segment, to form the reinforced composite sabot of the present invention. As mentioned above, each such metal wedge, 140, is joined by mechanical means, or glues, or combinations thereof, to each side of each composite sabot segment (FIG. 1) 40, 50. The aluminum, or other metal, wedges or plates (FIG. 1) 20, 30, or (HG. 2) 20, joined to each side of each composite sabot segment (FIG. 1) 40, 50, or (FIG. 2) 55, increases the torsional strength of the completed sabot (e.g. APFSDS) structure (FIG. 1) 10. Using the composite material segments (FIG. 1) 40, 50, or (FIG. 2) 55, along with the metal wedges (FIG. 1) 20, 30, or (FIG. 2) 20 provides a 25% weight reduction in parasitic mass. This reduction in weight significantly increases the performance of any KE penetrator that uses this sabot technology in rifled gun system—by providing higher muzzle velocity than prior technology all aluminum sabots, leading to extended range capability, and armor defeat.

Figure 4:
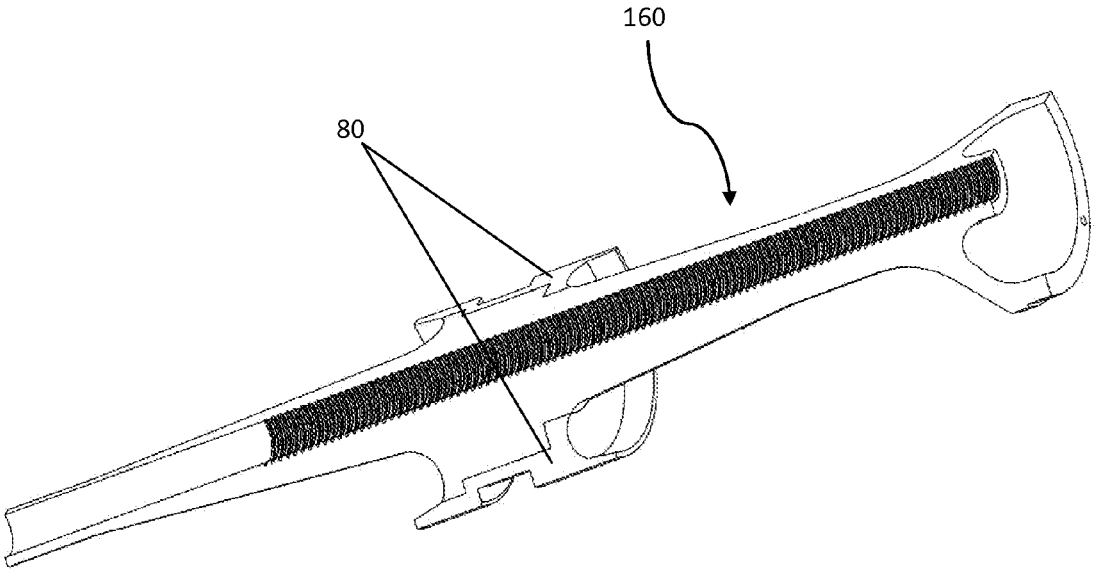
FIG. 4 is a perspective view of a single composite sabot segment according to the present invention, showing an alternate embodiment metal bulk head about the obturator thereof.

As can be seen in FIG. 4, a preferred embodiment of the present invention, a composite material sabot segment is shown, 160, which has a metal bulkhead, 80, joined to and about the exterior sides of the obturator ring that are opposed to the interior of the gun tube. This metal bulkhead, 80, is in addition to the above detailed metal reinforcements sandwiching each composite segment of the sabot (reinforcements which are not shown in FIG. 4). This metal bulkhead, 80, helps protects the sabot's obturator, (FIG. 1) 100, from the physical forces created where the obturator rides against the interior surface of the gun tube, and, more importantly, the metal surface created about the obturator and the slip band mechanism reduce the spin and thus reduce hoop stresses—further allowing the subject inventive sabot to survive the torsional stresses in a rifled, high spin, environment. Also, as can be seen in FIG. 4, the metal bulkhead can extend along the tail side of the obturator—to help protect the composite material exposed to the high pressure and temperature exploding propellant gases and particles impacting that tail side during firing.

In a preferred embodiment of the present invention, a three segment, or petal, sabot can be constructed such that each composite segment or petal is from about 90 to about 110 degree of arc about the circumference of the sabot, FIG. 1 arc $\alpha$. In such a case, the thin aluminum, or other, thin metal reinforcing wedges of the present invention will be from about 5 to about 15 degrees of arc about the circumference of the sabot, FIG. 1 arc β. Therefore, the six aluminum, or other, metal, wedges being joined one to the next, with the sandwiched composite segments therebetween, will form the 360 degrees of circumference arc of the completed sabot, to enclose the subcaliber penetrator. The thin aluminum wedges can preferable be as thin as about 5 degrees of arc, FIG. 1 arc β; but, to provide the necessary hoop strength the reinforcing metal wedges should not be any thinner than about 3 degrees of arc, FIG. 1 arc β.

The present invention is based upon the fact that generally composite structures load carrying capability is directional. Therefore, composite structures have more strength in the direction of the orientation of fibers; but, little in the other direction. In contrast, metals have much higher shear strength, almost half of the yield strength of the material. Therefore, use of the subject longitudinally aligned aluminum, or other metal, wedges or plates between the composite sabot segments provides the hoop strength necessary to withstand the launch force from a rifled gun tube system, such as the 105 mm or 120 rifled gun tube systems.

In the present invention, it is preferred that either a mechanical, or glue, or combination thereof means be used to connect the aluminum, or other, metal wedges to the composite segments, and to connect the metal bulkhead to the obturator ring. One preferred means is to use screws or rivets or pins to mechanically connect the aluminum, or other, metal wedges to the composite segments. Alternatively, glues, such as Araldite® AV 8503 Resin/Hardener HV 8503 epoxy adhesive, a two-component paste with a one-to-one by volume mix ratio, available from the Huntsman Corporation, The Woodlands, Tex. 77380. Araldite® AV 8503 Resin/Hardener HV 8503 epoxy adhesive fixes itself in one minute on a heated fixture at 240° F. (116° C.). Generally, it requires only a dry wipe for surface preparation before bonding. Finally, a combination of such mechanical and glue means can be used to securely fasten the metal wedges to the composite sections of the sabot and the metal wedges, and the metal bulkhead to the sabot segments.

In the present invention, the other metals useful as the material of choice for the manufacture for the subject wedges include titanium, magnesium, beryllium, or similar light weight metals, or alloy thereof (or, with such a metal and with aluminum). Further, many modern lightweight composite materials are useful in the subject invention and readily available, including various boron/epoxy and/or boron/aluminum systems available from Specialty Materials, Inc., Lowell, Mass.; carbon fiber composites, available from Element6 Composites, Elbridge, N.Y.; HexTow® carbon fibers available from Hexcel Corporation, Stamford, Conn.; cured epoxy systems available from Park Advanced Composite Materials, Inc., Waterbury, Conn.; Thermo-Lite™ materials available from TenCate Advanced Composites USA, Inc, Morgan Hill, Calif.; carbon fiber components available from Vermont Composites, Inc., Bennington, Vt.; and the like.

We claim:

1. A lightweight, metal insert reinforced, composite sabot projectile comprising:

at least 3 lightweight, composite, sabot segments;

wherein, each composite segment is sandwiched between two metal wedges, each metal wedge covering at least about 3 degrees of arc about the circumference of the sabot, and wherein one metal wedge is affixed on each side of each composite segment, which wedges have an outline identical to the composite sabot segment to which they are affixed;

each such sandwiched composite segment being aligned with the other sabot segments;

the aligned segments joined together by mechanical means; and wherein the joined segments form a sabot projectile that contains a KE penetrator, and which when fired from a rifled gun, will withstand the torsion forces without any loss of the body integrity of the sabot.

2. The lightweight metal insert reinforced composite sabot of claim 1, wherein the sabot has an obturator ring located within and joined to a metal bulkhead, which metal bulkhead is located about the periphery of the sabot near the midpoint thereof in opposition to the interior of the gun tube; wherein said metal bulkhead protects the obturator ring from the physical forces created where the obturator ring rides against the gun tube.

3. The lightweight metal insert reinforced composite sabot of claim 1, wherein each composite segment covers from about 90 to about 110 degrees of arc about the circumference of the sabot and wherein each metal wedge covers from about 5 to about 15 degrees of arc about the circumference of the sabot.

4. The lightweight metal insert reinforced composite sabot of claim 1, wherein the number of sabot segments is selected from the group consisting of 3, 4, and 5.

5. The lightweight metal insert reinforced composite sabot of claim 1, wherein the metal wedges are affixed by either mechanical means, or glue, or a combination thereof.

6. The lightweight metal insert reinforced composite sabot of claim 1, wherein the metal wedges are manufactured of aluminum, titanium, magnesium, beryllium, or similar light weight metal, or alloy thereof.

7. The lightweight metal insert reinforced composite sabot of claim 1, wherein the sabot is selected from the group consisting of 105 mm, 120 mm, medium and small caliber sabots.

* * * * *